US006917004B1

(12) United States Patent
Engdahl

(10) Patent No.: US 6,917,004 B1
(45) Date of Patent: Jul. 12, 2005

(54) EARTHQUAKE ACTUATED MICRO SWITCH

(76) Inventor: Paul D. Engdahl, 2930 Grace Ln., #E, Costa Mesa, CA (US) 92626

( * ) Notice: Subject to any disclaimer, the term of this patent is extended or adjusted under 35 U.S.C. 154(b) by 0 days.

(21) Appl. No.: 10/844,884

(22) Filed: May 14, 2004

(51) Int. Cl.[7] ..... H01H 35/14

(52) U.S. Cl. ..... 200/61.45 R; 200/61.52; 200/61.53

(58) Field of Search ..... 200/61.45 R–61.45 M; 73/514.01, 514.16, 514.29, 514.35

(56) References Cited

U.S. PATENT DOCUMENTS

| | | | | | |
|---|---|---|---|---|---|
| 2,312,234 | A | * | 2/1943 | Brandt | 200/61.52 |
| 2,946,867 | A | * | 7/1960 | Wehrig | 200/61.45 R |
| 3,217,120 | A | * | 11/1965 | Bowen et al. | 200/61.52 |
| 4,185,507 | A | | 1/1980 | Domyan | 74/2 |
| 4,261,379 | A | | 4/1981 | Berry | 137/39 |
| 4,789,922 | A | * | 12/1988 | Cheshire | 200/61.51 |
| 4,903,720 | A | | 2/1990 | McGill | 137/38 |
| 5,119,841 | A | | 6/1992 | McGill | 137/38 |
| RE38,220 | E | | 8/2003 | Engdahl | 137/38 |
| 2002/0014264 | A1 | | 2/2002 | Crane | 137/38 |

* cited by examiner

*Primary Examiner*—Michael A. Friedhofer
(74) *Attorney, Agent, or Firm*—Edgar W. Averill, Jr.; Kenneth L. Green, Esq.

(57) ABSTRACT

An earthquake actuated micro switch includes a ball which falls into a micro switch actuating position when disturbed. The ball normally resides in a shallow ball seat. A sufficient disturbance causes the ball to escape the ball seat, and fall into a switch seat. When the ball comes to rest in the switch seat, a lower surface of the ball pushes a micro switch actuator, thereby actuating the micro switch.

20 Claims, 5 Drawing Sheets

EARTHQUAKE ACTUATED MICRO SWITCH

BACKGROUND OF THE INVENTION

The present invention relates to earthquake safety devices, and more particularly to devices which actuate a micro switch as a result of an earthquake.

There is world wide concern regarding the effects of earthquakes. In recent years, earthquakes occurring around the world resulted in tens of thousands of deaths. Although modem building codes drastically reduce the human harm resulting from earthquakes, there is still a significant likelihood that deaths will occur even in modern countries. Although building codes have been successful in reducing the catastrophic collapse of structures, there is often substantial secondary damage resulting from gas fires, broken electrical wiring, and the like. Various devices have been developed to turn off gas lines and the like, either directly through a mechanical action, or indirectly through actuation of an electrical switch.

U.S. Pat. No. 4,185,507 for "Acceleration Responsive Tripping Mechanism," describes a ball sitting on a pedestal. When motion occurs, the ball falls off the pedestal into a surrounding chamber (or dish), causing the chamber to lower against a spring, and to trip a micro switch. Disadvantageously, the device of the '507 patent includes a number of moving parts including a spring, vertically moving piston, and levers. Devices such as this are generally mounted, and forgotten. There is typically little to no inspection or maintenance, and as a result, such complexity is an invitation to failure.

U.S. Pat. No. 4,261,379 for "Vibration/Temperature Sensitive Valve Operating Apparatus," describes a ball siting in a cup. Motion causes the ball to fall out of the cup, and the cup raises slightly, this motion releases a trigger which results in the desired actuation. Unfortunately the '379 patent also includes substantial mechanical complexity, including several arms, springs, and pins. Such mechanical complexity is undesirable for the reasons cited above.

BRIEF SUMMARY OF THE INVENTION

The present invention addresses the above and other needs by providing an earthquake actuated micro switch including an encased ball which falls into a micro switch actuating position when disturbed. The ball normally resides in a shallow ball seat. A sufficient disturbance causes the ball to escape the ball seat, and fall into a switch seat. When the ball comes to rest in the switch seat, a lower surface of the ball pushes a micro switch actuator, thereby actuating the micro switch.

In accordance with one aspect of the invention, there is provided an earthquake sensor comprising a ball, a switch body having a floor, a ball seat on the floor, a switch seat in the floor, and an electrical switch residing under the floor and having an upward facing switch actuator positioned at least partially under the switch seat. The ball resides in the switch body, wherein the ball is positionable by the ball seat when the floor is functionally in the horizontal plane. Motion of the body allows the ball to escape the ball seat and fall into the switch seat, wherein the switch seat is of sufficient diameter and shape to allow the ball, if residing in the switch seat, to actuate the switch actuator. A four conductor cable is electrically connected to the electrical switch. The conductor cable includes a normally open conductor, a normally closed conductor, a neutral conductor, and a ground conductor. A set control is actuable from external to the switch body for moving the ball from the ball seat to the switch seat, and a reset control is actuable from external to the switch body for moving the ball from the switch seat to the ball seat.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
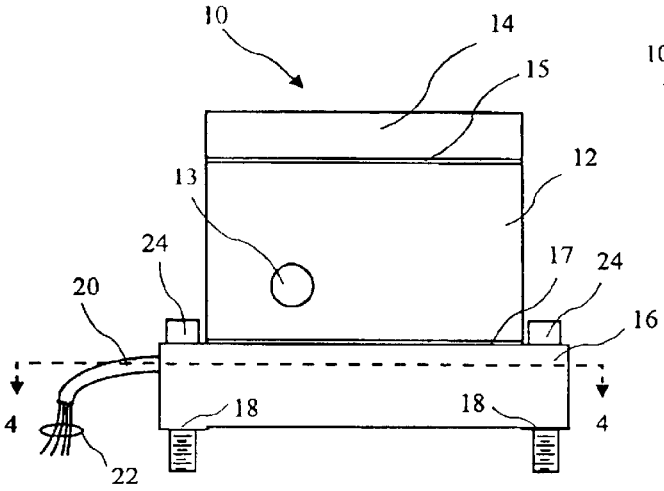
FIG. 1A is a side view of a motion actuated switch according to the present invention.

The present invention addresses the above and other needs by providing a motion actuated switch 10 including a center body portion 12, a cover 14, and a base 16 as shown in side view in FIG. 1A. The motion actuated switch 10 has some similarity to the earthquake actuated automatic gas shutoff valve described in U.S. Pat. No. Re. 38,220 issued to the inventor of the present invention. U.S. Pat. No. Re. 338,220 is herein incorporated by reference.

Figure 2A:
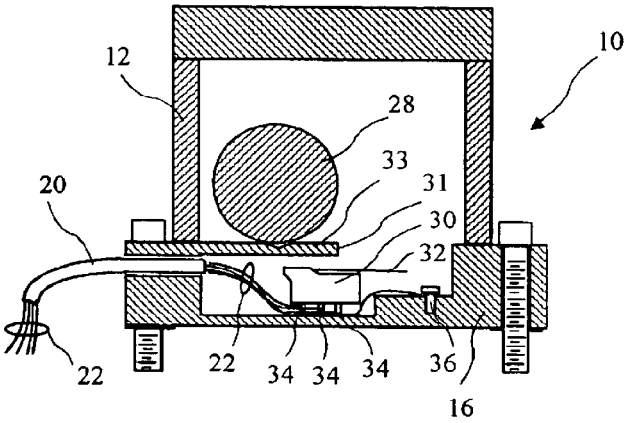
FIG. 2A is a cross-section view of the interior of the motion actuated switch taken along line 2—2 of FIG. 1C, with a ball in a ball seat.

The motion actuated switch 10 includes a sight port 13 which allows viewing of the position of a ball 28 (see FIG. 2A). Cover gasket 15 is positioned between the cover 14 and center body portion 12. A base gasket 17 is positioned between the base 16 and the center body portion 12. A cable 20 having four conductors 22 extends from the base 16. Pads 18 extend from the bottom of the base 16, and mounting screws 24 extend through the base 16 and pads 18. The pads 18 are preferably ½ inch square, and the mounting screws 24 are preferably approximately ¼ inch thread screws.

Figure 1B:
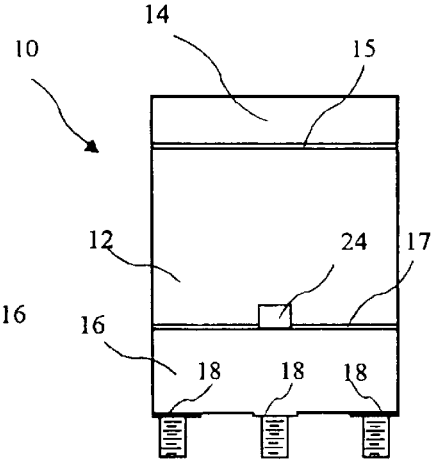
FIG. 1B is an end view of the motion actuated switch.
Figure 1C:
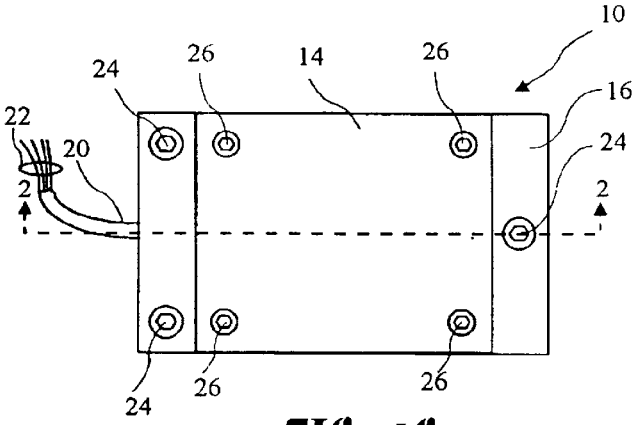
FIG. 1C is a top view of the motion actuated switch.

An end view of the motion actuated switch 10 is shown in FIG. 1B, and a top view of the motion actuated switch 10 is shown in FIG. 1C. Four cover screws 26 on for corners of the cover 14 attach the cover 14 to the center body portion 12. It is further seen that three mounting screws 24 extend through the base 16, which cover screws 26 and mounting screws 24 are preferably allen head screws. The center body portion 12, cover 14, and base 16 are preferably made from aluminum, and the screws 24, 26 are preferably made from stainless steel.

Figure 2B:
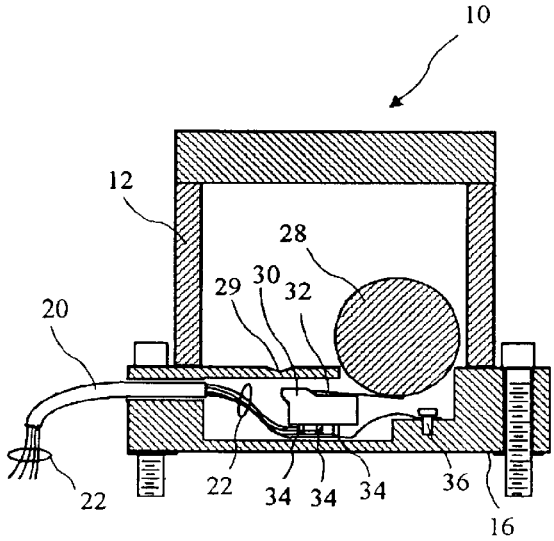
FIG. 2B is a second cross-section view of the interior of the motion actuated switch taken along line 2—2 of FIG. 1C, with the ball in a switch seat.

Cross sectional views of the interior of the motion actuated switch 10 taken along line 2—2 of FIG. 1C are shown in FIG. 2A with the ball 28 residing in a ball seat 29 (see FIG. 2B) and in FIG. 2B with the ball 28 residing in a switch seat 31 (see FIG. 2A), wherein the ball seat 29 and the switch seat 31 are formed in a floor 33 defined by the top surface of the base 16. The floor 33 is functionally horizontal, i.e., the ball seat 29 retains the ball 28 and the switch seat 31 retains the ball 28, once the ball 28 is in either seat 29, 31 in the absence of interference (e.g., motion) of the motion actuated switch 10, when the base 16 is on a horizontal surface. The sight port 13 (see FIG. 1A) may be located to see the ball 28 in either the ball seat 29 or in the switch seat 31. The ball 28 is preferably made from chrome steel.

Figure 2C:
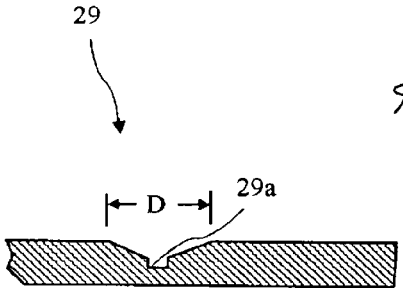
FIG. 2C is a detailed view of the ball seat.

A preferred ball seat 29 is shown in FIG. 2C and is described in detail in U.S. Pat. No. Re. 338,220, incorporated by reference above. The ball seat 29 comprises a conical depression having a diameter D. The diameter D of the ball seat 29 determines the actuation G level at higher frequencies. When used to turn off gas service, the standard calls for the closing of the valve at a G level of over 0.4 G at 10 Hz compared to 0.15 G at 2.5 Hz. For the same G level the movement at 10 Hz is only 1/16 that at 2.5 Hz. The diameter D of the seat can be made large enough to contain the 10 Hz movement while allowing the lower frequencies to actuate. To meet the standard, the diameter D is preferably about 0.375". The angle of the cone is preferably about 13 degree. Of course, the ball seat can be machined out and an insert added with a different angle and diameter for different actuation requirements. At 7.5 Hz and 10 Hz, the ball is shaking back and forth and cannot escape the ball seat just below the actuation level. A hole 29*a* at the apex of the ball seat 29 may be provided to improve ball seating stability for light balls 28.

Figure 7A:
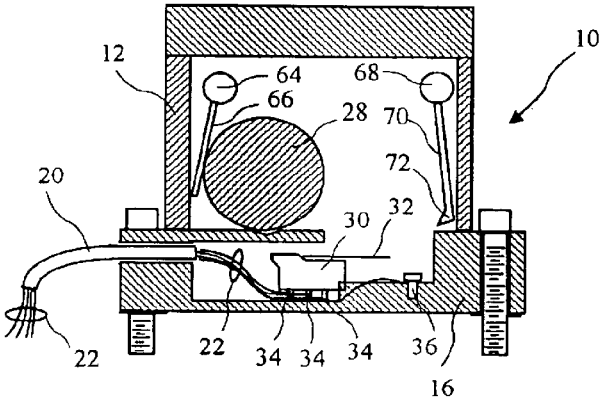
FIG. 7A is a cross-sectional view taken along line 2—2 of FIG. 1C of an embodiment of the motion actuated switch including a set control and reset control.
Figure 7B:
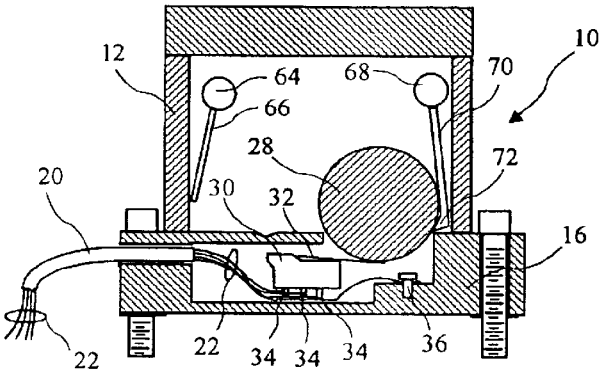
FIG. 7B is a second cross-sectional view taken along line 2—2 of FIG. 1C of an embodiment of the motion actuated switch including the set control and reset control.

The switch seat 31 is preferably large enough to allow the ball 28 to actuate the switch 30 when the ball 28 rests in the ball seat 31, and the ball seat 31 is preferably small enough to allow the ball 28 to be reset by use of the reset control (see FIG. 7B). It is thus seen that the size of the ball seat 31 is a function of the size of the ball 28, and of the position of the switch actuator 32.

A switch 30 is shown residing in the base 16, and a switch actuator 32 extends from the switch 30. The switch 30 is positioned to position the switch actuator 32 below the switch seat 31, so that when the ball 28 is resting in the switch seat 31 (as shown in FIG. 2B), the ball 28 pushed the switch actuator 32 down, and thereby actuates the switch 30. The switch 30 is preferably a micro switch, and more preferably a Single-Pole Double-Throw (SPOT) micro switch, for example, a part number 311 SX2-T micro switch manufactured by Honeywell in Morristown, N.J. While a switch with a straight switch actuator 32 is described herein, a switch having any suitable switch actuator is intended to come within the scope of the present invention, for example, a roller lever.

The switch 30 preferably has three contacts 34. The cable 20 preferably includes four conductors 22 comprising a normally open conductor, a normally closed conductor, a neutral conductor, and a ground conductor. Three of the four conductors 22 are electrically connected to the switch 30, and one of the conductors 22 is electrically connected to the base 16, preferably by a ground screw 36. The cable 20 preferably has a jacket wall and is approximately 0.228 inches in diameter, and the conductors 22 are preferably 20 AWG insulated conductors. A preferred cable is a part number NQ-420 SJ available from National Wire and Cable Corporation in Los Angeles, Calif.

Figure 3A:
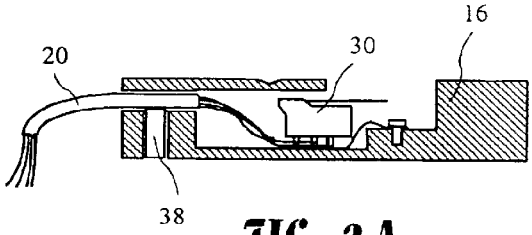
FIG. 3A is a cross-section view of a base only of the motion actuated switch taken along line 2—2 of FIG. 1C, showing a set screw used to retain a cable in the base.

A cross-section view of a base 16 only of the motion actuated switch 10 taken along line 2—2 of FIG. 1C is shown in FIG. 3A. A set screw 38 is used to retain the cable 20 in the base 16. The cable 20, the entry hole in the base 16 for the cable 20, the set screw 38, and the threaded hole in the base 16 for the set screw 38, are preferably coated with a sealant, and more preferably with Dow Coming RTV 734 Adhesive Sealant. The set screw 38 is preferably a ¼–20 by ⅜ inch hex socket set screw, preferably having a cup point.

Figure 3B:
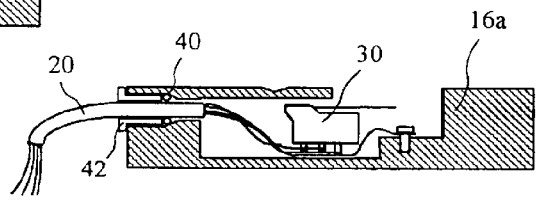
FIG. 3B is a second cross-section view of the base only of the motion actuated switch taken along line 2—2 of FIG. 1C, showing an O-Ring and O-Ring retainer used to retain the cable in the base.

A cross-section view of a second embodiment comprising a base 16*a* only of the motion actuated switch 10 taken along line 2—2 of FIG. 1C is shown in FIG. 3B showing an O-Ring 40 and O-Ring 42 retainer used to retain the cable 20 in the base 16.

Figure 3C:
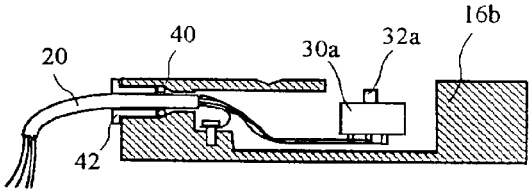
FIG. 3C is a third cross-section view of the base only of the motion actuated switch taken along line 2—2 of FIG. 1C, showing a second micro switch having a plunger type actuator.

A cross-section view of an embodiment comprising a base 16*b* only of the motion actuated switch 10 taken along line 2—2 of FIG. 1C is shown in FIG. 3C. The base 16*b* includes a second micro switch 30*a* having a plunger type actuator 32*a*. The micro switch 30*a* is positioned with the actuator 32*a* approximately centered under the switch seat 31 and at a height which allows the ball 28 to actuate the micro switch 30*a* when the ball 28 resides in the switch seat 31.

Figure 4A:
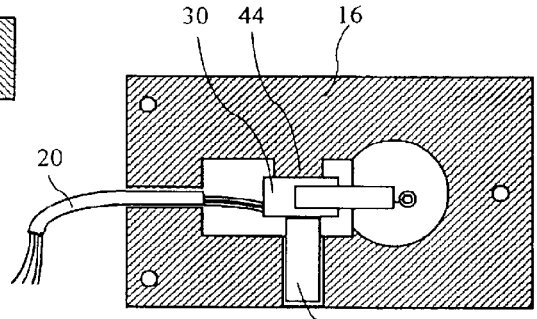
FIG. 4A shows cross-sectional view of a second set screw used to secure a switch in the base taken along line 4—4 of FIG. 1A.
Figure 4B:
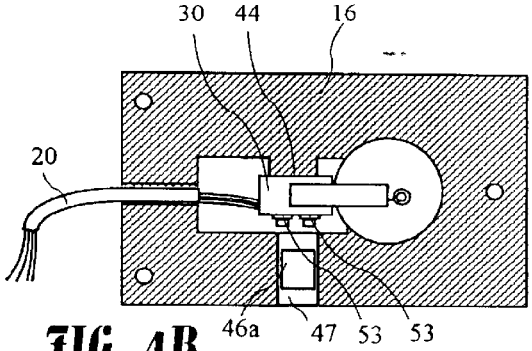
FIG. 4B shows cross-sectional view of two screws with washers used to secure the switch in the base taken along line 4—4 of FIG. 1A.

The switch 30 is shown in FIG. 4A fixed in the base 16 by a second set screw 46, in a cross-sectional view taken along line 4—4 of FIG. 1A. The switch 30 is held between the set screw 46 and a switch support surface 44. The set screw 46 is preferably sealed using RTV 734 Adhesive Sealant. A second embodiment is shown in FIG. 4B wherein two screws with washers 53 hold the switch 30 against the switch support surface 44. A short set screw 46*a* resides in an opening 47 in the base 16, which opening 47 is used to drill and tap screw holes, and to install the screws with washers 53.

Figure 5:
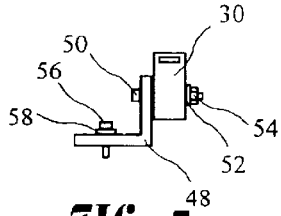
FIG. 5 shows a bracket used to secure the switch in the base.

In another embodiment, the switch 30 is attached to the base 16 by a switch bracket 48 shown in FIG. 5. The bracket 48 is attached to the switch 30 by a switch screw 50 and switch nut 54, with a switch washer 52 between the switch 30 and the nut 54. A bracket screw 56 may be used to attach the bracket 48 to the base 16, with a bracket washer 58 between the head of the bracket screw 56 and the bracket 48. While the methods shown in FIGS. 4A, 4B, and 5 are preferred, a motion actuated switch with a switch attached by any method is intended to come within the scope of the present invention. The washers 52 and 58 are preferably lock washers.

Figure 6A:
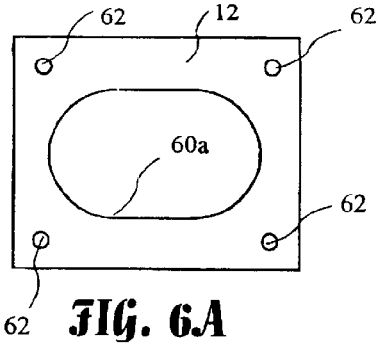
FIG. 6A shows a top view of a center body portion having an inner shaped wall.
Figure 6B:
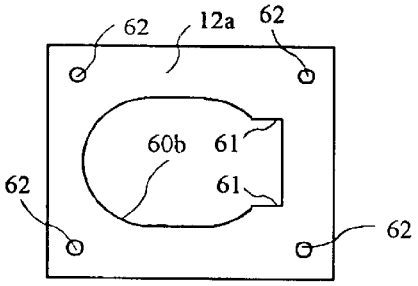
FIG. 6B shows a top view of the center body portion having a second inner shaped wall suitable for use with a reset control.

Top views of two embodiments of the center body portion are shown in FIGS. 6A and 6B. The center body portion 12 has an oval shaped first inner shaped wall 60*a*. The inner shaped wall 60*a* provides a surface for deflecting the ball 28 toward the switch seat 31, and preferably the inner shaped wall 60*a* is shaped to be within one ball radius from the switch seat 31. A second center body portion 12*a* has a second inner shaped wall 60*b* having additional reliefs 61 provided for second arms 70 (see FIG. 7A, 7B). The cover 14 is attached to the center body portions 12, 12*a* using screw holes 62 in the center body portions 12, 12*a*.

An embodiment of a motion actuated switch with set and reset controls is shown in FIGS. 7A and 7B. The set control comprises a set shaft 64 and at least one first arm 66. The reset control comprises a reset shaft 68 and at least one second arm 70. There are preferably two arms 66 and two arms 70, and the arms 70 may include hands 72 at lower ends, which hands 72 contact the ball 28 below center to facilitate lifting the ball 28 out of the switch seat 31 (see FIG. 2A). The ball 28 is shown in the ball seat 29 (see FIG. 2B) in FIG. 7A, wherein rotating the arms 66 toward the ball 28 caused the ball 28 to escape the ball seat 29. The ball 28 is shown in the switch seat 31 in FIG. 7B, wherein rotating the arms 70 toward the ball 28 lifts the ball 28 out of the switch seat 31. Additional details and embodiments of set and reset controls are described in detail in U.S. Pat. No. Re. 338,220, incorporated by reference above.

Figure 8:
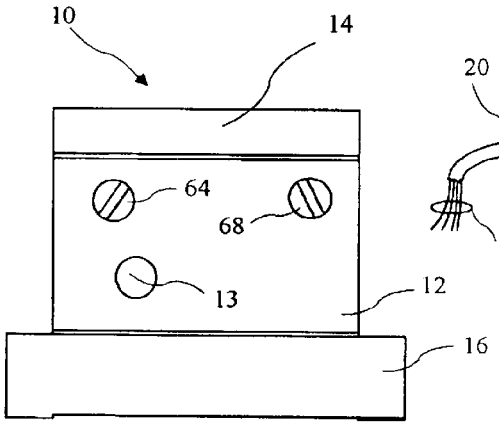
FIG. 8 is a side view of the motion actuated switch showing set and reset controls.

The shafts 64, 68 preferably extend through the side of the center body portion 12 as shown in FIG. 8. The set control and reset control are thus actuable from external to the center body portion 12 to set or to reset the ball.

Figure 9A:
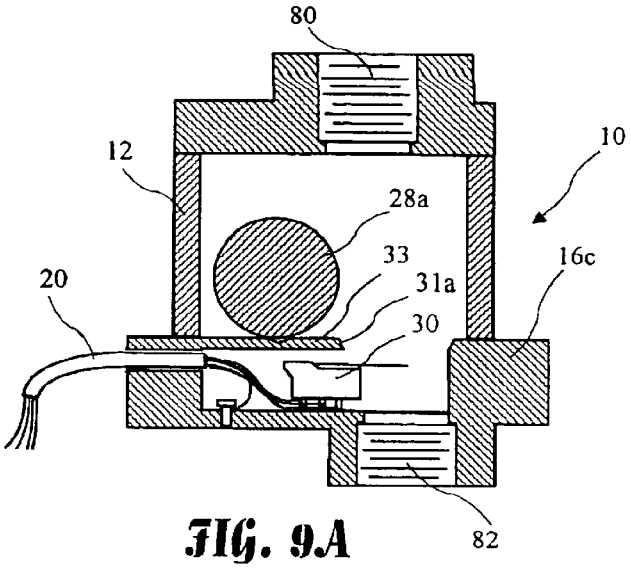
FIG. 9A is a cross-section view of the interior of the motion actuated switch taken along line 2—2 of FIG. 1C, with a ball in the ball seat and with a gas inlet and gas outlet.
Figure 9B:
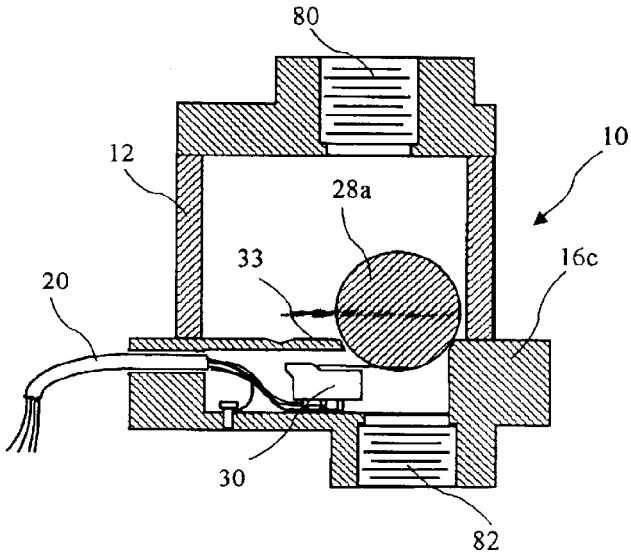
FIG. 9B is a second cross-section view of the interior of the motion actuated switch taken along line 2—2 of FIG. 1C, with the ball in the switch seat and with the gas inlet and the gas outlet.

In some situations both a mechanical gas shutoff and an electrical switch may be desired or required. A motion actuated switch combining both a mechanical gas shutoff and an electrical switch is shown in FIGS. 9A and 9B. A preferred second ball 28*a* and second ball seat 31*a* are described in U.S. Pat. No. Re. 338,220, incorporated by reference above. The ball 28*a* is shown on the ball seat 29 in FIG. 9A, wherein a gas flow entering at an inlet 80 flows through the body 12 and out an outlet 82, and the switch 30 is not actuated. The ball 28*a* is shown on the switch seat 31*a* in FIG. 9B, wherein the gas flow entering at the inlet 80 is blocked from flowing through the body 12, and the switch 30 is actuated. The cable 20 may, for example, be connected to a bell or other alarm, or to a remote site using a wired (e.g., phone lines or internet type connection) or wireless transmission. The cable 20 may further be connected to an electrical valve to turn off a flow of gas or water or other liquid, or may turn off an electrical circuit.

While the invention herein disclosed has been described by means of specific embodiments and applications thereof, numerous modifications and variations could be made thereto by those skilled in the art without departing from the scope of the invention set forth in the claims.

I claim:

1. A motion actuated electrical switch comprising:

a ball;

a switch body having a floor, the ball residing in the switch body;

a ball seat on the floor, wherein the ball is positionable by the ball seat when the floor is functionally in the horizontal plane;

a switch seat in the floor; and an electrical switch residing under the floor and having an upward facing switch actuator positioned at least partially under the switch seat, wherein motion of the body allows the ball to escape the ball seat and fall into the switch seat, and wherein the switch seat is of sufficient diameter and shape to allow the ball, if residing in the switch seat, to actuate the switch actuator.

2. The motion actuated electrical switch of claim 1, wherein the electric switch is a micro switch.

3. The motion actuated electrical switch of claim 2, wherein the micro switch is a Single-Pole Double-Throw (SPDT) micro switch.

4. The motion actuated electrical switch of claim 2, wherein the switch actuator is a straight lever.

5. The motion actuated electrical switch of claim 1, further including a four conductor cable electrically connected to the electrical switch, wherein the conductor cable comprises:

a normally open conductor;

a normally closed conductor;

a neutral conductor; and a ground conductor.

6. The motion actuated electrical switch of claim 1, wherein the switch body has a sealed interior.

7. The motion actuated electrical switch of claim 1, wherein the ball seat is a shallow conical recess in the floor, wherein the recess has a substantially vertical central axis.

8. The motion actuated electrical switch of claim 1, further comprising a set control actuable from external to said body for moving said ball from the ball seat to the switch seat.

9. The motion actuated electrical switch of claim 8, wherein said set control comprises:

a set shaft supported by said body above the ball seat; and at least one first downwardly extending arm rotatable by said set shaft and extending downwardly to a first lower end positioned adjacent said ball and opposite to said switch seat when said ball is residing in said ball seat, wherein, rotating the first downwardly extending arm toward the ball causes the ball to move out of the ball seat and toward the switch seat.

10. The motion actuated electrical switch of claim 1, further comprising a reset control actuable from external to said body for moving said ball from the switch seat to the ball seat.

11. The motion actuated electrical switch of claim 10, wherein said reset control comprises:

a reset shaft supported by said body above the switch seat; and at least one second downwardly extending arm rotatable by said reset shaft and extending downwardly to a lower end positioned adjacent said ball and opposite to said ball seat when said ball is residing in said switch seat, wherein, rotating the second downwardly extending arm toward the ball causes the ball to move out of the switch seat and toward the ball seat.

12. The motion actuated electrical switch of claim 1, further including a sight glass in said body adjacent a position of said ball when said ball rests in at least one of said ball seat and said switch seat, whereby the position of the ball may be determined by looking through said sight glass.

13. The motion actuated electrical switch of claim 1, wherein the body comprises:

a center body portion;

a cover portion affixed to said center body portion; and a base portion affixed to said center body portion, said base portion including the floor.

14. The motion actuated electrical switch of claim 13, wherein the center body portion includes an inner shaped wall for deflecting the ball toward the switch seat.

15. The motion actuated electrical switch of claim 14, wherein the inner shaped wall is shaped to be within one ball radius from the switch seat.

16. The motion actuated electrical switch of claim 14, wherein the ball escapes the seat if the body experiences an acceleration of at least 0.4 of Gravity G, and at least ten Hz.

17. The motion actuated electrical switch of claim 1, wherein the electric switch has a plunger type actuator.

18. An earthquake sensor comprising:

a ball;

a switch body having a floor, the ball residing in the switch body;

a ball seat on the floor, wherein the ball is positionable by the ball seat when the floor is functionally in the horizontal plane;

a switch seat in the floor;

an electrical switch having a switch actuator positioned at least partially under the switch seat;

a set control actuable from external to said body for moving said ball from the ball seat to the switch seat; and a reset control actuable from external to said body for moving said ball from the switch seat to the ball seat, wherein motion of the body allows the ball to escape the ball seat and fall into the switch seat, and wherein the switch seat is of sufficient diameter and shape to allow the ball, if residing in the switch seat, to actuate the switch actuator.

19. A motion actuated electrical switch comprising:

a ball;

a switch body having a floor and including a cover portion having an inlet and a base portion having an outlet, the ball residing in the switch body;

a ball seat on the floor, wherein the ball is positionable by the ball seat when the floor is functionally in the horizontal plane;

a switch seat in the floor;

an electrical switch having a switch actuator positioned at least partially under the switch seat; and wherein motion of the body allows the ball to escape the ball seat and fall into the switch seat, and wherein the switch seat is of sufficient diameter and shape to allow the ball, if residing in the switch seat, to actuate the switch actuator.

20. The motion actuated electrical switch of claim 19, further including:

a set control actuable from external to said body for moving said ball from the ball seat to the switch seat; and a reset control actuable from external to said body for moving said ball from the switch seat to the ball seat.

* * * * *